US005178430A

United States Patent [19]

Schopfer

[11] Patent Number: 5,178,430

[45] Date of Patent: Jan. 12, 1993

[54] TRANSPORT CASE FOR ONE OR A FEW GARMENT HANGERS

[76] Inventor: E. Kevin Schopfer, 474 Glen Rd., Weston, Mass. 02193

[21] Appl. No.: 851,834

[22] Filed: Mar. 16, 1992

[51] Int. Cl.[5] ..... A45C 13/26; A45F 5/10

[52] U.S. Cl. ..... 294/142; 294/163; 294/165

[58] Field of Search ..... 294/137, 141-143, 294/145, 149, 153, 158, 159, 162, 163, 165, 167-169, 170; 206/279, 284, 285, 300; 211/113, 124; 223/85, 88, 98; 248/317, 340

[56] References Cited

U.S. PATENT DOCUMENTS

| | | | |
|---|---|---|---|
| 2,769,587 | 11/1956 | Threeton | 294/142 |
| 3,606,967 | 9/1971 | Roberts | 294/143 |
| 3,633,802 | 1/1972 | Webster | 294/143 |
| 3,692,218 | 9/1972 | Friedman | 294/142 X |
| 3,705,674 | 12/1972 | Fisher | 294/165 |
| 3,744,600 | 7/1973 | Belland et al. | 294/142 X |
| 3,804,310 | 4/1974 | Wheeler | 294/142 |
| 3,885,723 | 5/1975 | Magnie | 294/142 |
| 3,961,734 | 6/1976 | Threeton | 294/143 |
| 4,288,012 | 9/1981 | Doak | 294/143 |
| 4,296,959 | 10/1981 | Helbig | 294/143 |
| 4,335,839 | 6/1982 | Kessler et al. | 294/142 |
| 4,474,316 | 10/1984 | Philibert | 223/88 |
| 4,557,516 | 12/1985 | Usner | 294/143 |
| 4,709,954 | 12/1987 | Beyda et al. | 294/142 |

*Primary Examiner*—Johnny D. Cherry
*Attorney, Agent, or Firm*—Fish & Richardson

[57] ABSTRACT

A device for receiving and containing, during transport, the hooks of one or a few garment hangers, consists of a case having an arcuate integral base wall defining a support surface for supporting one or a few garment hanger hooks, first and second side walls upstanding along opposite peripheral edges of the base wall and at least one upstanding end wall extending between the side walls. The walls together define an arcuate chamber for receiving and retaining one or a few garment hanger hooks. At least one of the walls moves relative to the base wall in a manner to permit access for the garment hanger hooks and can be secured to retain the garment hanger hooks within the chamber during transport.

12 Claims, 7 Drawing Sheets

TRANSPORT CASE FOR ONE OR A FEW GARMENT HANGERS

BACKGROUND OF THE INVENTION

The invention relates to a case for receiving and retaining the hooks of a one or a few garment hangers for transport.

A typical suit bag consists of a flexible bag sized to contain a number of suits, shirts, dresses, etc. for travel, the bag having a zippered opening for placing the garments therewithin. The garments are usually on hooked hangers, and the hooks extend through an opening provided at the top of the bag. The multiple hooks, often of different shapes and types, can create a hazard and/or an annoyance to the traveller as they become engaged on clothing and anything else that passes within range. Furthermore, the collection of hooks is often bulky, and it is difficult to engage the hooks as a unit over clothes racks or the like. Finally, if the hooks are not secured together and to be handled as the unit, the unengaged hanger and the clothing placed upon it, often ends up in a tangled heap at the bottom of the bag.

Others have thought to provide a case for garment hooks to assist travelers using a garment or suit bag. For example, Threeton, U.S. Pat. No. 2,769,587, describes a tubular case which opens along a central vertical axis and provides a ring for receiving the ends of the hangers. Magnie, U.S. Pat. No. 3,885,723, describes a carrier device which is flexed to permit a hanger hook to be inserted into an elongated cavity. Doak, U.S. Pat. No. 4,288,012, describes a handle which defines a magazine for receiving garment hanger hooks to be secured by a removable retainer pin.

SUMMARY OF THE INVENTION

According to one aspect of the invention, a device for receiving and containing, during transport, the hooks of one or a few garment hangers comprises a case comprising an arcuate integral base wall defining a support surface for supporting one or a few garment hanger hooks, a first side wall upstanding along a first peripheral edge of the base wall, a second, opposed side wall upstanding along a second peripheral edge of the base wall, and at least one upstanding end wall extending between the first side wall and the second side wall and spaced from the support surface, the base wall, the first side wall, the second side wall and the end wall defining an arcuate chamber sized and constructed to receive and retain one or a few garment hanger hooks with a stem opening, and at least one wall is adapted for movement relative to the base wall in a manner to permit access for garment hanger hooks into and from the chamber, and means for securing the moveable wall for retaining the one or a few garment hanger hooks within the chamber during transport.

Preferred embodiments of the invention may include one or more of the following features. One end wall has a first vertical edge and a second vertical edge and is hingedly attached to the first side wall along the first vertical edge and it is adapted for movement between a first position with the second vertical edge at least in close proximity to the second side wall, thereby to retain one or a few garment hanger hooks within the chamber, and a second position with the second vertical edge spaced from the second side wall, thereby to permit access for one or a few garment hanger hooks into and from the chamber. Preferably, the means for securing the movable wall comprises a securement member defining a slot and a strap having a first end attached to the case and a second free end, the movable wall defining an aperture sized and adapted to pass over the securement member to expose the slot, and the free end of the strap adapted to be lodged within the slot in a manner to resist removal of the aperture of the at least one end wall from over the securement member. Preferably, the free end of the strap comprises means, e.g. transverse ribs, for resisting dislodgement of the strap from the slot. The case defines a notch sized and constructed for suspension of the device from a rod and the like. The device has a first end wall and a second end wall, and the second side wall has a left vertical edge and a right vertical edge, the second side wall being hingedly attached to the first end wall along the left vertical edge, and the second side wall being adapted for movement between a first position with the right vertical edge at least in close proximity to the second end wall, thereby to retain one or a few garment hanger hooks within the chamber, and a second position with the right vertical edge spaced from the second end wall, thereby to permit access for one or a few garment hanger hooks into and from the chamber. Preferably, the device further comprises a handle extending above the case. The side walls and the end wall are an integral unit that is mounted for pivoting movement relative to the base wall between a first position in which a stem end portion of the support surface is in relatively close opposition to the end wall, thereby to retain one or a few garment hanger hooks within the chamber, and a second position in which the stem end portion of the support surface is relatively more spaced from opposition with the end wall in a region of the stem opening, thereby to permit access for one or a few garment hanger hooks into and from the chamber. Preferably, the case further comprises a third upstanding wall vertically bisecting the chamber. Also, the device further comprises a handle extending above the case, and a hook attached to the handle and pivotable between a first position extending above the handle for suspension of the device from a rod and the like and a second position retracted into a slot defined by the handle.

These and other features and advantages of the invention will be seen from the following description of presently preferred embodiments, and from the claims.

DESCRIPTION OF PRESENTLY PREFERRED EMBODIMENTS

I first briefly describe the drawings.

Figure 1:
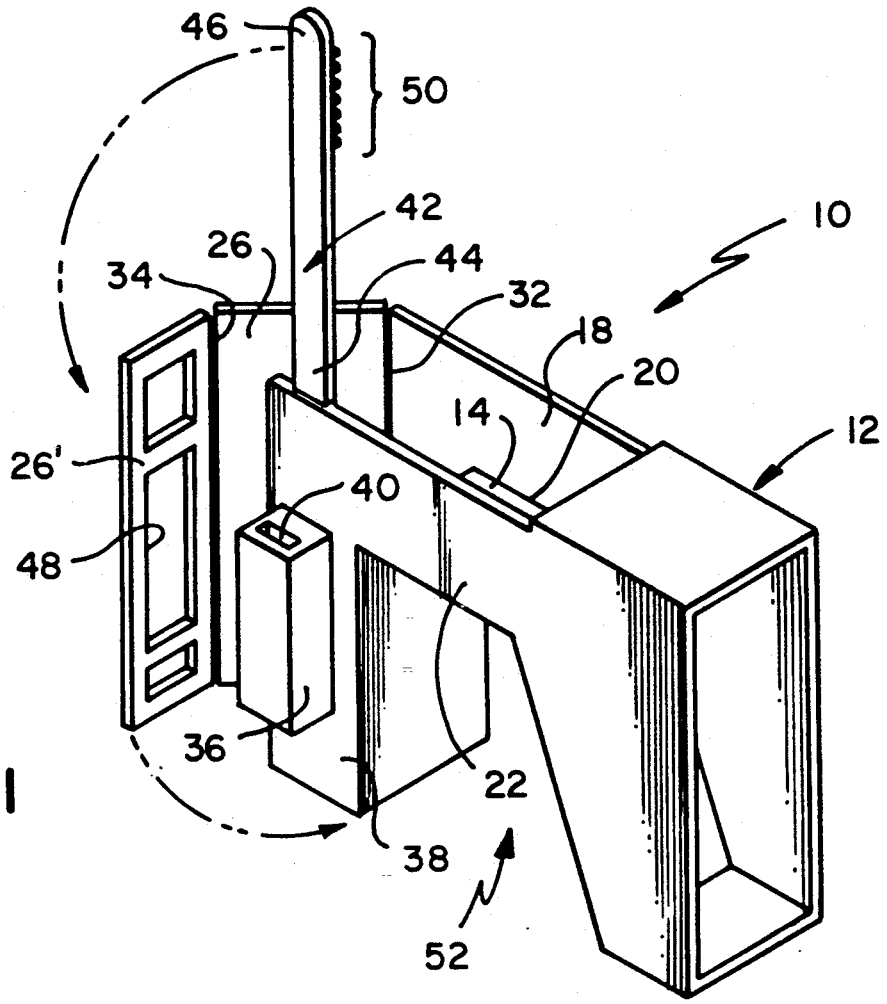
FIG. 1 is a perspective view of a garment hanger hook case device of the invention open for receiving and removal of garment hanger hooks.
Figure 2:
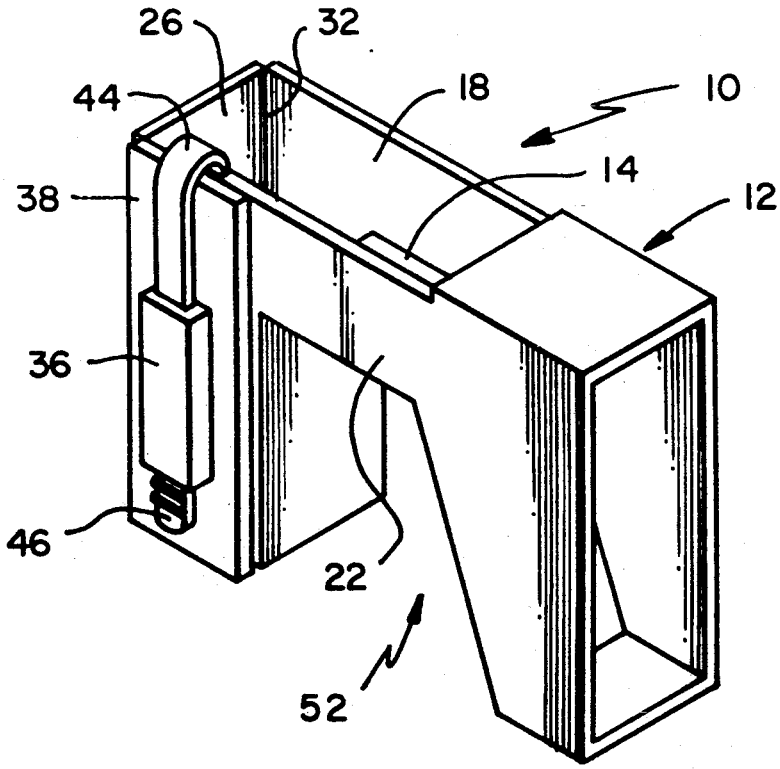
FIG. 2 is a similar view of the case device of FIG. 1 closed for retaining garment hanger hooks.
Figure 3:
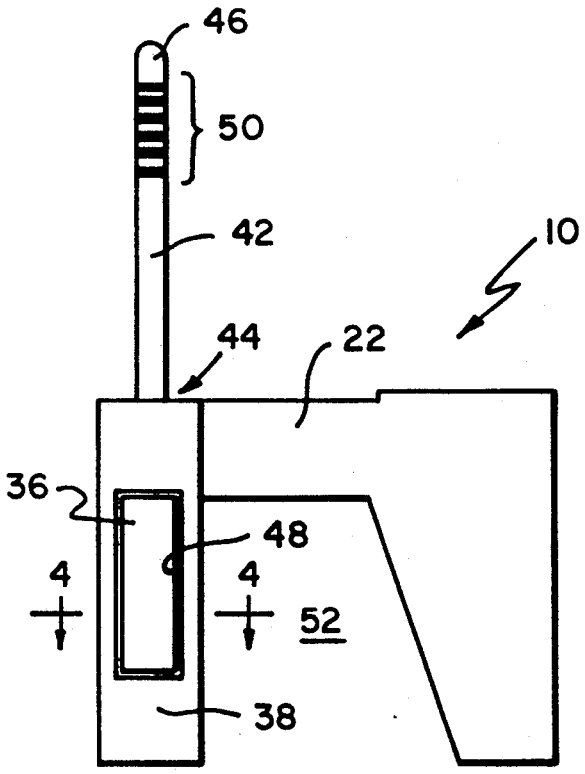
FIG. 3 is a front plan view of the case device of the invention of FIGS. 1 and 2.
Figure 4:
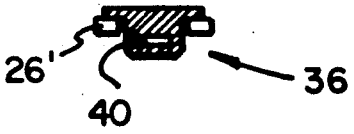
FIG. 4 is a top sectional view of the securement element taken at the line 4—4 of FIG. 3.
Figure 5:
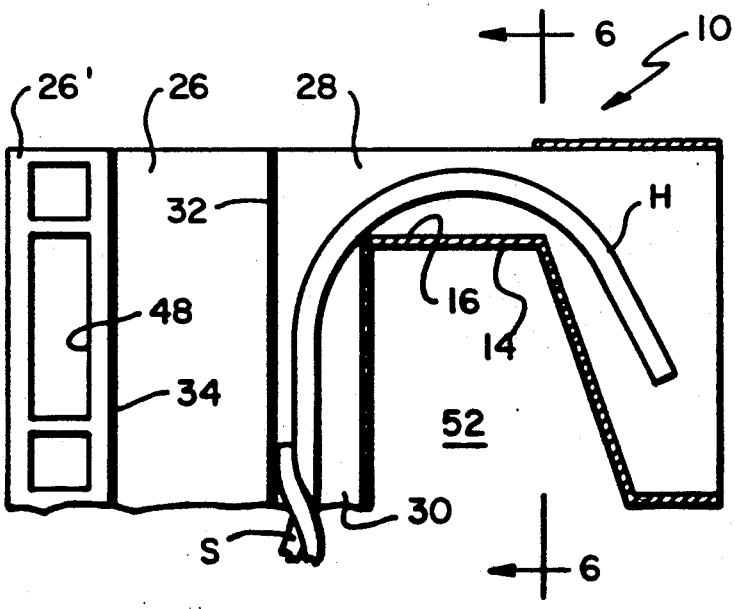
Figure 6:
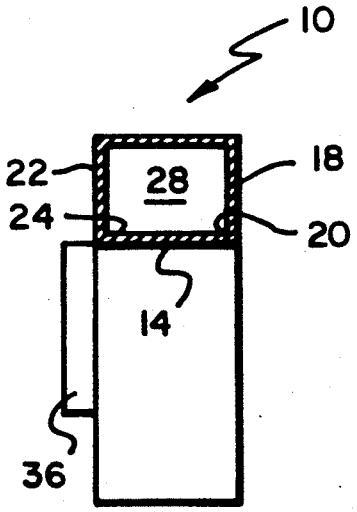

FIG. 5 is a front plan view, partially in section, of the case device of the invention of FIGS. 1 and 2; and FIG. 6 is a side sectional view of the case device of the invention of FIGS. 1 and 2, taken at the line 6—6 of FIG. 5.

Figure 7:
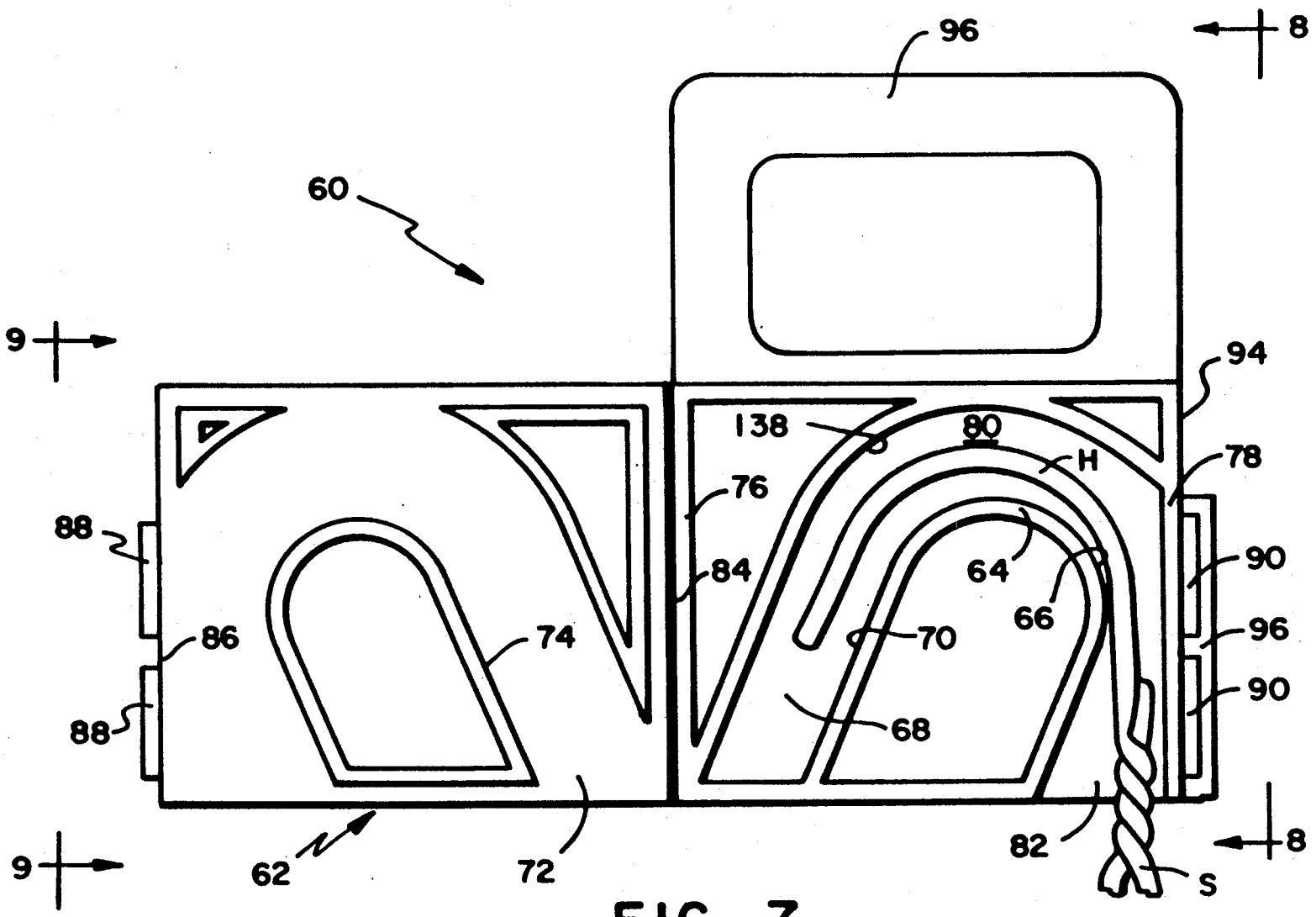
Figure 8:
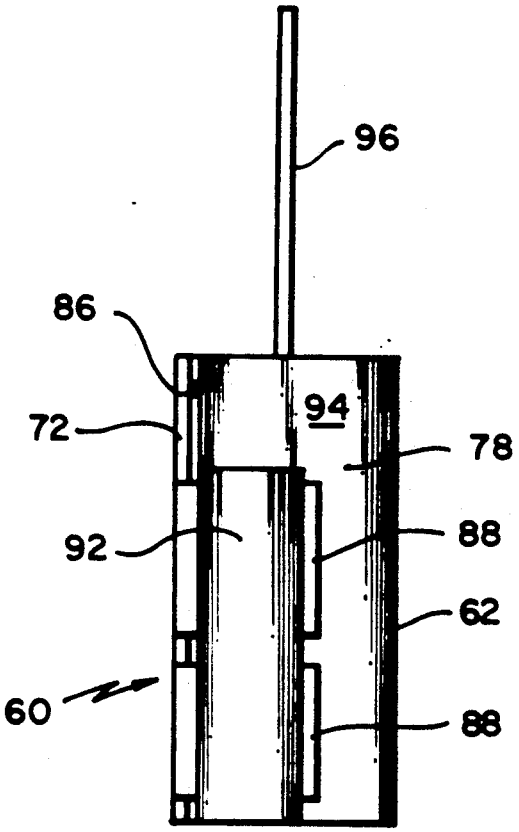

FIG. 7 is a front plan view of another embodiment of a garment hanger hook case device of the invention open for receiving and removal of garment hanger hooks;

FIG. 8 is an end sectional view of the case device of FIG. 7; and

Figure 9:
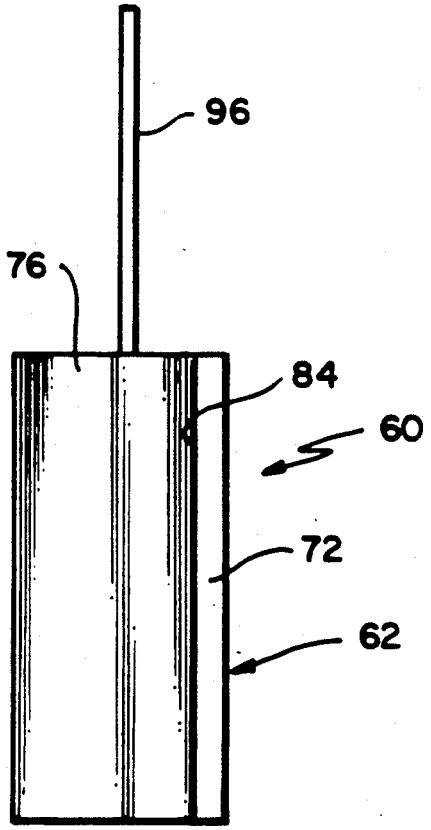

FIG. 9 is an end view of the case device of FIG. 7.

Figure 11:
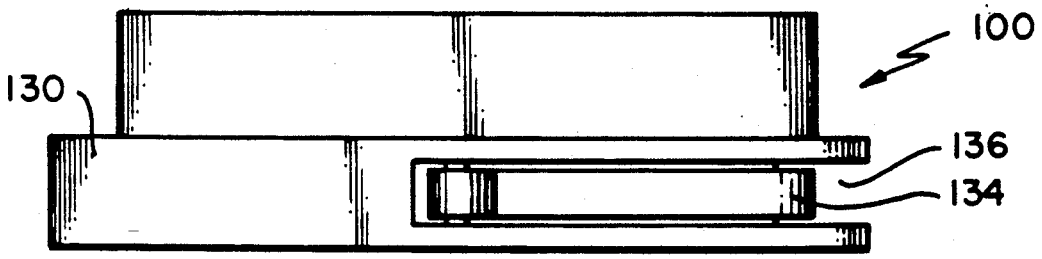
Figure 10:
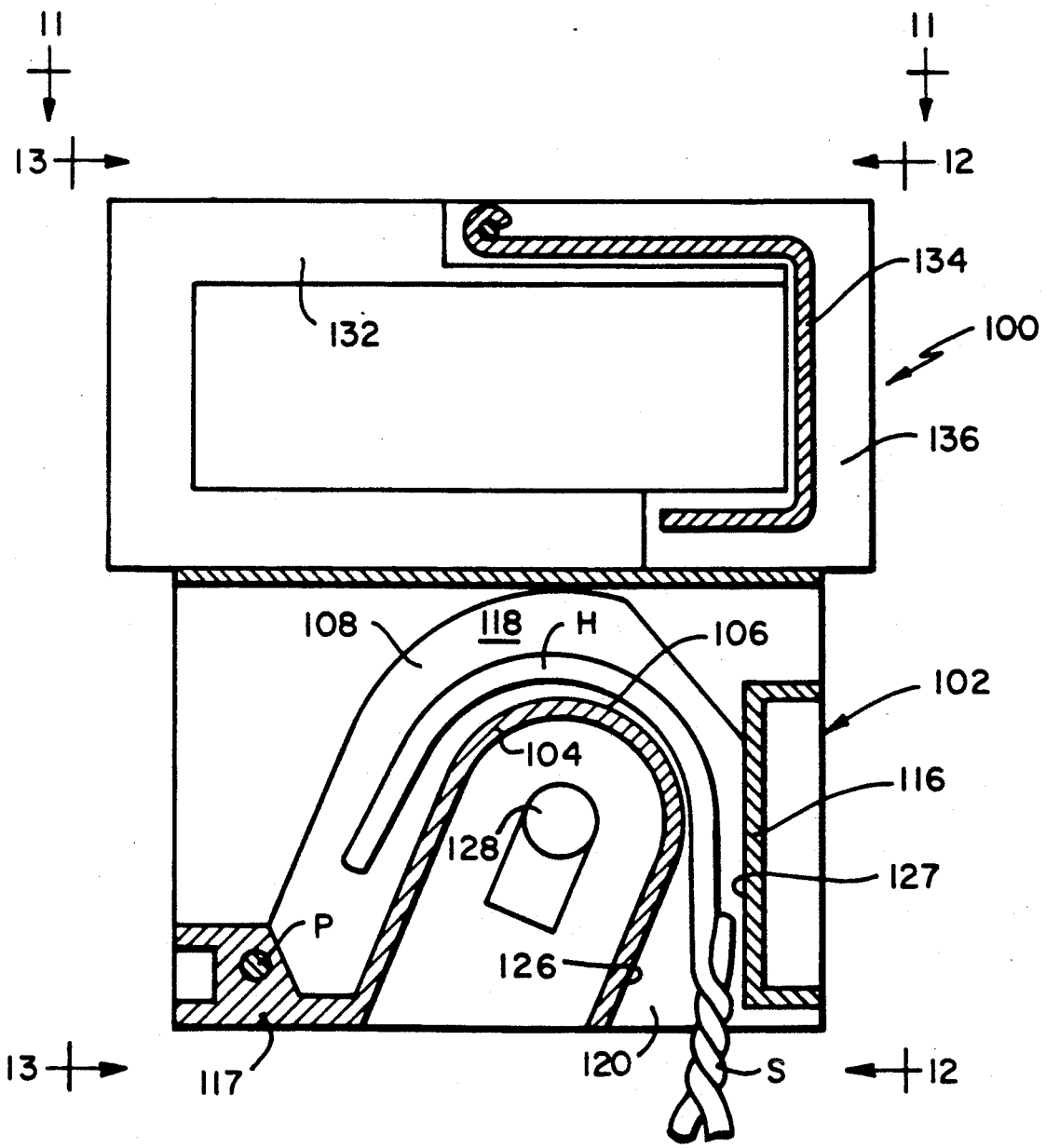
Figure 12:
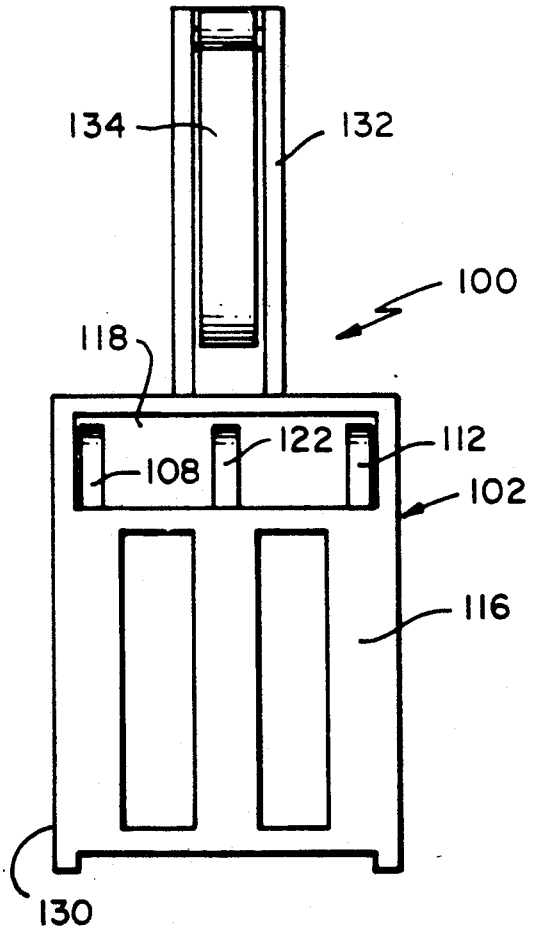
Figure 13:
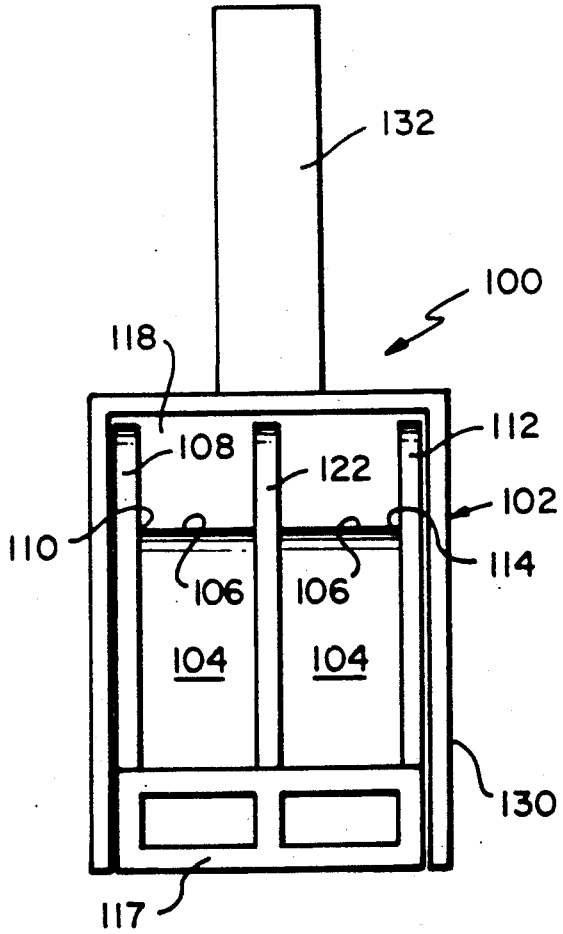
Figure 14:
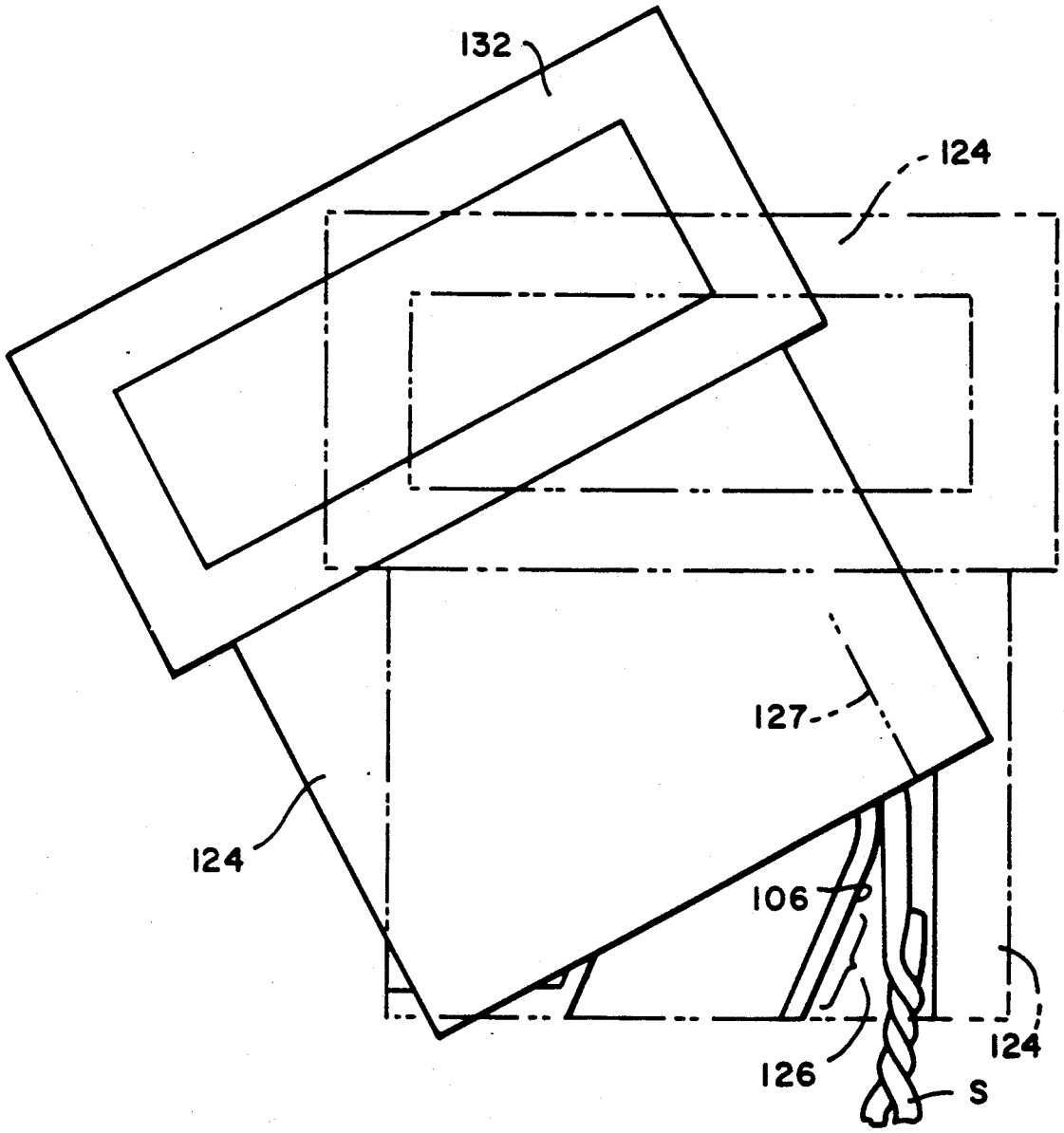

FIG. 10 is a front plan view, partially in section, of yet another embodiment of a garment hanger hook case device of the invention open for receiving and removal of garment hanger hooks;

FIG. 11 is a top view of the case device of FIG. 10;

FIG. 12 is a first side view of the case device taken at the line 12—12 of FIG. 10;

FIG. 13 is a second side view of the case device taken at the line 13—13 of FIG. 10; and FIG. 14 is a somewhat diagrammatic view of the case device of FIG. 10 showing the case device closed for retaining garment hanger hooks and, in dashed line, showing the case device open for receiving and removal of garment hanger hooks.

Referring now to FIGS. 1-6, there is shown a device 10 of the invention for receiving and containing, during transport, the hooks of one or a few garment hangers of a wide range of sizes and types, including metal wire and bar, and plastic. For example, in one preferred embodiment, the device is about 2½ inches (6.35 cm) in length by about 2 inches (5.08 cm) high by about ⅞ inch (2.22 cm) wide.

The device, which is formed of plastic or another suitable material, consists of a case 12 having an arcuate integral base wall 14 defining a support surface 16 for supporting one or a few garment hanger hooks H, a first side wall 18 upstanding along a first peripheral edge 20 of the base wall, a second, opposed side wall 22 upstanding along a second peripheral edge 24 of the base wall, and an upstanding end wall 26 extending between the first side wall and the second side wall and spaced from the support surface. The base wall 14, the first side wall 18, the second side wall 22 and the end wall 26 define an arcuate chamber 28 that is sized and constructed to receive and retain one or a few garment hanger hooks H, the chamber having with a stem opening 30 through which the hanger stem S extends.

In this embodiment of the device of the invention, the end wall 26 has a first vertical edge 32 and a second vertical edge 34, the end wall being hingedly attached to the first side wall 18 along the first vertical edge 32. The end wall is adapted for movement between a first position (FIG. 2) with the second vertical edge 34 in close proximity to the second side wall 22, thereby to retain one or a few garment hanger hooks within the chamber 28, and a second position (FIG. 1) with the second vertical edge 34 spaced from the second side wall 22, thereby to permit access for one or a few garment hanger hooks into and from the chamber.

In order to secure the end wall 26 for retaining one or a few garment hanger hooks H within the chamber 28 during transport, the device 10 further has a securement member 36 formed on the front surface 38 of the case 12. The securement member 36 defines a slot 40, and there is also provided a strap 42 having a first end 44 attached to the case 12 and a second, free end 46. The end wall 26 has a flap portion 26' hingedly attached along second vertical edge 34. The flap portion 26' defines an aperture 48 sized and adapted to pass over the securement member 36 to expose the slot 40, and the free end 46 of the strap 42 may be lodged within the slot in a manner to resist removal of the aperture of the end wall from over the securement member, the free end of the strap having a series of transverse ribs 50 to resist dislodgement of the strap from the slot.

The case 12 also defines a notch 52 that allows the device to be suspended from a rod and the like.

Referring now to FIGS. 7-9, there is shown another embodiment of the device 60 of the invention for receiving and containing, during transport, the hooks H of one or a few garment hangers.

The device 60 consists of a case 62 having an arcuate integral base wall 64 defining a support surface 66 for supporting the one or a few garment hanger hooks H, a first side wall 68 upstanding along a first peripheral edge 70 of the base wall, a second, opposed side wall 72 upstanding along a second peripheral edge 74 of the base wall, and a first upstanding end wall 76 and a second upstanding end wall 78, both extending between the first side wall and the second side wall and spaced from the support surface. The base wall 64, the first side wall 68, the second side wall 72 and the end wall 78 define an arcuate chamber 80 that is sized and constructed to receive and retain one or a few garment hanger hooks H, the chamber having with a stem opening 82 through which the hanger stems S extend.

In the device 60, the second side wall 72 has a left vertical edge 84 and a right vertical edge 86, the second side wall being hingedly attached to the first end wall 76 along the left vertical edge 84 and adapted for movement between a first position (FIGS. 8 and 9) with the right vertical edge 86 in close proximity to the second end wall 78, thereby to retain one or a few garment hanger hooks within the chamber, and a second position (FIG. 7) with the right vertical edge 86 spaced from the second end wall 78, thereby to permit access for one or a few garment hanger hooks into and from the chamber 80.

In an alternate embodiment of structure for securing the second side wall 72 for retaining one or a few garment hanger hooks H within the chamber during transport, the device 60 has tabs 88 extending from the right vertical edge 86 for interference engagement within apertures 90 defined by securement member 92 formed on the surface 94 of the second end wall 78 of the case 62.

The device 60 further includes a handle 96 extending above the case 62.

Referring now to FIGS. 10-14, there is shown yet another embodiment of the device 100 of the invention for receiving and containing, during transport, the hooks of one or a few garment hangers H.

The device 100 consists of a case 102 having an arcuate integral base wall 104 defining a support surface 106 for supporting one or a few garment hanger hooks H, a first side wall 108 upstanding along a first peripheral edge 110 of the base wall, a second, opposed side wall 112 upstanding along a second peripheral edge 114 of the base wall, and an upstanding end wall 116 extending between the first side wall and the second side wall and spaced from the support surface. The base wall 104, the first side wall 108, the second side wall 112 and the end wall 116, together with strut 117, define an arcuate chamber 118 that is sized and constructed to receive and retain one or a few garment hanger hooks H, the chamber having with a stem opening 120 through which the hanger stems S extend. A third upstanding wall 122 vertically bisects the chamber 118 from the support surface 106 of the base wall 104.

In this embodiment of the device 100 of the invention, the first side wall 108, the second side wall 112 and the end wall 116 (and the handle 132, described below) are an integral unit 124 which is mounted for pivoting movement about the axis P of strut 117, relative to the base wall 104, between a first position (FIG. 14, dashed line) in which a stem end portion 126 of the support surface 106 is in relatively close opposition to surface 127 (FIG. 10) of the end wall 116, thereby to retain one or a few garment hanger hooks within the chamber, and a second position (FIG. 14, solid line) in which the stem end portion 126 of the support surface 106 is relatively more spaced from opposition with the surface 127 of the end wall 116 in a region of the stem opening 120, thereby to permit access for one or a few garment hanger hooks into and from the chamber.

In another alternate embodiment of structure for securing the integral unit 124 relative to the base wall 104 for retaining one or a few garment hanger hooks H within the chamber 118 during transport, the device 100 has a spring biased button 128. The button 128, exposed upon the rear surface 130 of the case 102, is depressed to disengage the button locking mechanism from the unit to allow its pivoting movement from the first position to the second position. When the unit is returned to the second position, the button locking mechanism in re-engaged to secure the unit.

The device 100 further includes a handle 132 extending above the case 102, and a hook member 134 attached to the handle. The hook member is pivotable between a first position extending above the handle for suspension of the device from a rod and the like and a second position (FIG. 10) retracted into a slot 136 defined by the handle.

Other embodiments are within the following claims. For example, referring to FIG. 7, the relationship of the support surface 66 and an opposed surface 138 defining the chamber 80 may be arranged relative to the arc of curvature standard for most garment hanger hooks H in a manner so that the surfaces of the garment hanger hook engage upon the opposed surfaces 66, 138 to prevent removal of the garment hanger hook H from the case 62 by way of the stem opening 82, unless the hook is forcibly deformed.

What is claimed is:

1. A device for receiving and containing, during transport, the hooks of one or a few garment hangers, said device comprising a case comprising an arcuate integral base wall defining a support surface for supporting one or a few garment hanger hooks, a first side wall upstanding along a first peripheral edge of said base wall, a second, opposed side wall upstanding along a second peripheral edge of said base wall, and at least one upstanding end wall extending between said first side wall and said second side wall and spaced from said support surface, said base wall, said first side wall, said second side wall and said at least one end wall defining an arcuate chamber sized and constructed to receive and retain one or a few garment hanger hooks with a stem opening, and at least one said wall adapted for movement relative to said base wall in a manner to permit access for garment hanger hooks into and from said chamber, and means for securing said at least one said wall for retaining the one or a few garment hanger hooks within said chamber during transport.

2. The device of claim 1 wherein said at least one end wall has a first vertical edge and a second vertical edge, said at least one end wall being hingedly attached to said first side wall along said first vertical edge and said at least one end wall being adapted for movement between a first position with said second vertical edge at least in close proximity to said second side wall, thereby to retain one or a few garment hanger hooks within said chamber, and a second position with said second vertical edge spaced from said second side wall, thereby to permit access for one or a few garment hanger hooks into and from said chamber.

3. The device of claim 2 wherein said means for securing said at least one said wall for retaining one or a few garment hanger hooks within said chamber during transport comprises a securement member defining a slot and a strap having a first end attached to said case and a second free end, said at least one end wall defining an aperture sized and adapted to pass over said securement member to expose said slot, and said free end of said strap adapted to be lodged within said slot in a manner to resist removal of the aperture of said at least one end wall from over said securement member.

4. The device of claim 3 wherein the free end of said strap comprises means for resisting dislodgement of said strap from said slot.

5. The device of claim 4 wherein said means for resisting comprises transverse ribs.

6. The device of claim 1 wherein said case defines a notch sized and constructed for suspension of said device from a rod and the like.

7. The device of claim 1 wherein said at least one end wall comprises a first end wall and a second end wall, and said second side wall has a left vertical edge and a right vertical edge, said second side wall being hingedly attached to said first end wall along said left vertical edge, and said second side wall being adapted for movement between a first position with said right vertical edge at least in close proximity to said second end wall, thereby to retain one or a few garment hanger hooks within said chamber, and a second position with said right vertical edge spaced from said second end wall, thereby to permit access one or a few garment hanger hooks into and from said chamber.

8. The device of claim 7 further comprising a handle extending above said case.

9. The device of claim 1 wherein said first side wall and said second side wall and said at least one said end wall are an integral unit and said unit is mounted for pivoting movement relative to said base wall between a first position in which a stem end portion of said support surface is in relatively close opposition to said at least one end wall, thereby to retain one or a few garment hanger hooks within said chamber, and a second position in which said stem end portion of said support surface is relatively more spaced from opposition with said one least one end wall in a region of said stem opening, thereby to permit access for one or a few garment hanger hooks into and from said chamber.

10. The device of claim 9 wherein said case further comprises a third upstanding wall vertically bisecting said chamber.

11. The device of claim 9 further comprising a handle extending above said case.

12. The device of claim 11 further comprising a hook member attached to said handle and pivotable between a first position extending above said handle for suspension of said device from a rod and the like and a second position retracted into a slot defined by said handle.

* * * * *